US008316915B2

(12) United States Patent
Drifka et al.

(10) Patent No.: US 8,316,915 B2
(45) Date of Patent: Nov. 27, 2012

(54) HIGH SPEED DOOR ASSEMBLY

(75) Inventors: Brian Norbert Drifka, Richfield, WI (US); Arno Klein, Nordstemmen (DE); John Sonn, Slinger, WI (US); Donald P. Grasso, Wilmette, IL (US); Daniel J. Gregoriou, Kewaskum, WI (US); Walenty Kalempa, Slinger, WI (US)

(73) Assignee: Rytec Corporation, Jackson, WI (US)

( * ) Notice: Subject to any disclaimer, the term of this patent is extended or adjusted under 35 U.S.C. 154(b) by 522 days.

(21) Appl. No.: 12/375,630

(22) PCT Filed: Jul. 30, 2007 (Under 37 CFR 1.47)

(86) PCT No.: PCT/US2007/017049

§ 371 (c)(1), (2), (4) Date: Feb. 11, 2010

(87) PCT Pub. No.: WO2008/016573

PCT Pub. Date: Feb. 7, 2008

(65) Prior Publication Data

US 2011/0005138 A1 Jan. 13, 2011

Related U.S. Application Data

(60) Provisional application No. 60/834,193, filed on Jul. 29, 2006, provisional application No. 60/877,475, filed on Dec. 27, 2006.

(51) Int. Cl.
*E06B 9/17* (2006.01)

(52) U.S. Cl. ..... 160/271; 160/194; 160/195

(58) Field of Classification Search ..... 160/194, 160/195, 271
See application file for complete search history.

(56) References Cited

U.S. PATENT DOCUMENTS

| | | | | |
|---|---|---|---|---|
| 2,350,288 | A * | 5/1944 | Michelman | 160/133 |
| 4,887,660 | A | 12/1989 | Kraus | |
| 5,139,074 | A | 8/1992 | Warner | |
| 5,141,043 | A | 8/1992 | Kraeutler | |
| 5,222,541 | A | 6/1993 | Hornberger | |
| 5,307,857 | A | 5/1994 | Kraeutler | |
| 5,307,859 | A | 5/1994 | Kraeutler | |
| 5,379,823 | A | 1/1995 | Kraeutler | |
| 5,450,890 | A | 9/1995 | Pinkalla et al. | |
| 5,655,591 | A | 8/1997 | Knutson | |
| 5,878,803 | A * | 3/1999 | Kraeutler | 160/271 |
| 6,089,305 | A | 7/2000 | Gruben et al. | |
| 6,394,172 | B1 | 5/2002 | Kessous | |
| 6,574,832 | B1 | 6/2003 | Boerger et al. | |
| 2002/0139491 | A1 | 10/2002 | Langenbach | |
| 2005/0211391 | A1 | 9/2005 | Varley et al. | |
| 2006/0144530 | A1 | 7/2006 | Nagare et al. | |
| 2010/0032105 | A1 * | 2/2010 | Drifka | 160/8 |
| 2011/0005138 | A1 * | 1/2011 | Drifka et al. | 49/360 |

* cited by examiner

*Primary Examiner* — Blair M. Johnson
(74) *Attorney, Agent, or Firm* — Factor Intellectual Property Law Group, Ltd

(57) ABSTRACT

The present invention is directed to an industrial high-speed door assembly having a reduced door panel width and having guides for guiding the door which extend into a passageway but are resilient, tough, or resiliently collapsible, to either withstand impacts from vehicle collisions or moveable during opening of the door to avoid collisions while returning for guidance upon closing the door.

5 Claims, 6 Drawing Sheets

A
WALL
$F_A$
14
INITIAL POSITION
$F_B$
24
25
22
30
RETRACTED POSITION
B

14
W
16
A
WALL
24, 26
12
25, 27
22, 23
B

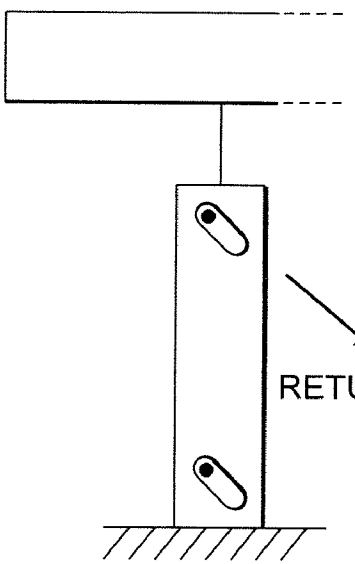
FIG. 10A
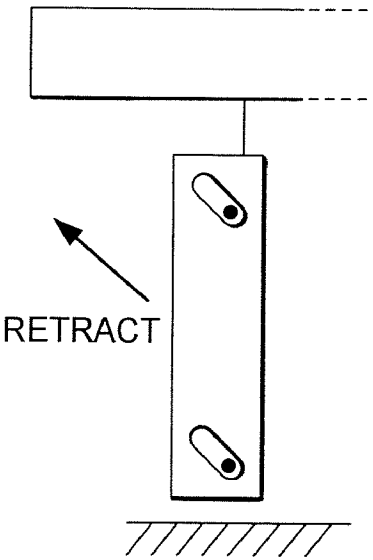
FIG. 10B
FIG. 10C

HIGH SPEED DOOR ASSEMBLY

RELATED APPLICATIONS

This is a National Phase Application based on International Patent Application Serial Number PCT/US2007/017049, filed Jul. 30, 2007; which claims the filing benefit of U.S. Provisional Application Serial No. 60/834,193 filed Jul. 29, 2006 and U.S. Provisional Application Ser. No. 60/877,475 filed Dec. 27, 2006. The contents of each of these applications are incorporated herein by reference.

TECHNICAL FIELD

The present invention relates to an industrial high-speed door assembly, and more specifically, to facilitating the realignment of a door panel that has been displaced from its normal operative configuration.

RELATED APPLICATIONS

This application is related to and relies upon, the priority of U.S. Provisional Application Nos. 60/834193 filed Jul. 29, 2006,and 60/877,475 Dec. 27, 2006.

BACKGROUND OF THE INVENTION

High-speed industrial doors, which are capable of being rolled up on a shaft or drum to open, have long been used in the storing and staging areas of commercial buildings such as factories and warehouses. Materials handling machinery, such as conveyors and lift trucks are commonly used to transport items to, from, and between storage areas and staging areas such as loading docks. In such applications, as well as others known in the art, the industrial doors are often required to open quickly, such as opening at a rate of approximately 48 inches per second up to 100 inches per second or greater. This speed enhances productivity, cost savings, and safety, especially where cold storage and distribution is involved. Additionally, specific environmental or security requirements may need door speed and sealing integrity to be maintained in either the storing or staging area or both, e.g., temperature, cleanliness, etc.

Conventional high-speed roll-up door assemblies include a pair of vertically oriented assemblies installed proximate the vertical sides of an opening defining the passageway for people and commercial vehicles and are sometimes called "side columns", or "guide assemblies". The side columns are have structures which guide the flexible door panel during opening and closing. These "guides" provide surfaces which engage a vertical marginal edge portion of the moving door panel therein. The guide assemblies are installed on only one side of the opening and do not extend into the width of the opening so as to maximize the clear path of travel for freight-moving vehicles traversing the passage, and to avoid damage to the assemblies from collisions. The flexible door panel, often including its accompanying parts, e.g., a relatively rigid bottom bar, guide retention means such as rollers, knobs, etc., is thus made wider than the width of the opening such that a vertical margin of the door panel on each side of the opening near the vertical side edges thereof, extends into and is thus guided or retained within the guides.

Even though the door panel is moved vertically at a relatively fast rate, there are times when the door panel—or a portion of the door assembly itself—is impacted by a vehicle and dislodged from at least one of the guides. The door assembly cannot operate properly until the displaced door panel is reconfigured to be within the door assembly's guides so as to be in its normal operating configuration.

Reconfiguring or "repairing" the door's guiding function after an impact has been the subject of the design of others including the applicants of this application. However, the prior art has only limited or no solutions for restoring or "repairing" of an automatic high speed roll up door when it is dislodged in a direction which places the panel inside of, or through, the opening of the passage. In this case, with a conventional roll-up door, the wider door panel will be pushed through the narrower opening distorting its normal shape so as to comply with the width of the opening of the passage. As a result, the door panel and its associated structures as well as the side columns and the wall portions constituting the opening, are more susceptible to damage both because of the dislodging and the gesticulations required to repair the door to its operational state. These difficulties can result in commercial losses due to lost productivity, thermal losses, and loss of environmental integrity on one or both sides of the door. Repairing the door may also tend to damage the door panel or guide assemblies. The repair from such a dislodgement is routinely accomplished through human operator effort, and is not automated. The door panel must be moved back to the other side of the opening before being realigned and reinserted within the guides. Returning the door panel to the door-assembly side of the opening can be difficult—perhaps even requiring disassembly of portions of the door assembly—and may incur additional time, and further expose the door panel to more damage.

It is known in U.S. Pat. Nos. 5,141,043 and 5,319,015 to provide a "self-repairable" industrial door assembly having side uprights each including a slideway having a guide wall on either side of the plane of a door panel or curtain. Lateral portions of the curtain slide within the slideways and are adapted to escape from the slideways in the event of an abnormal or atypical transverse force. However, these doors work well only if the dislodgement of the door panel in the direction of the side of the opening where the guide assemblies are installed. If the door is displaced in the opposite direction, the stiff (relative to repairing) door panel material is forced to deform from its unbuckled state to fir within the opening. Automated or easy repair on such an instance can again be costly and/or can put undue wear on the door panel and guide assemblies.

Applicant is aware of low speed doors used in U.S. car washes which have loose or relatively wide stationary guides installed on the inside a door opening and have relatively non-stiff, light weight material comprising the door panel. These doors can repair themselves with some degree of success when dislodged in either direction. However, the low speed and reduced weight and stiffness of these doors are unacceptable for applications like freezer and warehouse applications because of the commercial demands for security, wind load, insulating ability, and high speed. Also, the flexibility of these light weight panels reduces potential damage while problems in waiting for repair are less critical in the car wash application. There is also far less criticality to maximizing the door opening width. In the meantime automobile traffic guided through a car wash, especially by its owner, does not experience the high speed and high rate of freight-vehicle traffic that high speed industrial door assemblies are required to manage or the higher rate of collisions between door and vehicle.

The present invention is provided to address these and other considerations.

SUMMARY OF THE INVENTION

In the broadest aspect of the invention, the door panel is sized to better fit between the opposites sides of an opening in a wall to which a door assembly is mounted to facilitate enhanced manual, and preferably automated self-repair, of a door panel when it is dislodged from its vertical guides, such as by impact with a vehicle into a passageway defined in part by the opening. A door so sized can more easily be retracted (to an open position) for re-feeding into its guides than one which, as is conventional, is sized to be wider than the opening for guiding.

To accommodate this sizing of the panel, guides for the panel are sized and configured to extend into the passageway generally defined by the opening. To reduce or eliminate the problems associated with this configuration one or more the following novel techniques for a high speed door is contemplated.

The goals of the invention can be achieved by at least a portion of the panel guides which extend into the passageway can be constructed to effectively minimize reduction of the passageway by allowing workers to effectively treat the opening as being equal to the passageway by reducing damage to the guides if hit. In some embodiments, this is accomplished constructing at least the portion of at least one of the guides which) protrudes into the passageway: (1) of a resilient and/or tough material (e.g. Buna N rubber) such that the guide portions can withstand a hit and return resiliently or mechanically to their pre-contact position for guiding; or (2) in a way which allows at least one of the guides to collapse when hit and return afterwards for guiding by virtue of either its shape and configuration alone or shape, configuration, and material properties.

The objects of the invention can also be achieved by constructing one or both of the guides (or at least a vertically lower portion of same which is most commonly hit) in a way where—upon activation of the door for opening, or at least during initial opening of the door, the guide(s) is automatically moved outwardly away from the passageway to define a larger passageway during opening. This accomplishes accommodation of guiding the narrower door panel and reduces the likelihood of the guide(s) being hit and the likelihood of the panel being dislodged from the guides in a way which requires repairing. It is contemplated that this latter method and configurations may be carried out by various motive devices such as: solenoids moving at least the lower portion of a guide(s) or tripping a spring or other device upon activation which will move it; or linear variable displacement transducers; or motor-driven gear drives; or the like. According to one embodiment of the invention described more fully below, as a result of door activation and movement of the door panel upwardly, a counterweight used to assist in raising the door panel, is configured to interact with a guide assembly to retract it during opening to prevent the guide from protruding into the passageway during traverse of same by a vehicle.

Accordingly, one embodiment of the present invention is directed to a high-speed door assembly capable of vertically moving a flexible door panel to permit and prohibit access through an opening having a width defined by opposed sides. The high-speed door assembly is adapted for displacement of its door panel from its operative path of travel upon receiving an atypical dislodging force and includes a first guide operatively mounted proximate the opening and having opposed surfaces between which a portion of the door panel is guided during movement of the door panel and wherein at least a portion of the opposed surfaces extends into the opening. The high-speed door assembly also includes a second guide operatively mounted proximate the opening and having opposed surfaces between which a portion of the door panel is guided during movement of the door panel and wherein at least a portion of the opposed surfaces extends into a passageway defined by the opening.

Another aspect of the present invention includes that at least one of the guides is collapsible wherein a portion thereof is flexible and capable of retracting upon impact thereto; and subsequently being capable of substantially returning to its initial operative configuration.

A further aspect of the present invention includes at least one of the opposed surfaces of either guide including a realignment ramp attached thereto and proximate the top of the opening. The realignment ramp may be movable and projects upward and at an angle away from the path of travel so as to facilitate operative alignment of the door panel within the path of travel subsequent to the displacement of the door panel there from.

In yet another aspect of the present invention, the high-speed door assembly includes a motor for vertically moving the door panel to permit and prohibit access through the opening. A sensor for detecting atypical movement of the door is operatively coupled to the motor such that the motor is capable of reacting to the event, to stop panel movement, reverse it, slow its speed, go into a "repair mode", or combinations of these.

Yet another aspect of the present invention is directed to a high-speed door assembly operatively mounted proximate an opening with a width of the opening defined by opposed sides. The high-speed door assembly vertically moves a door panel to permit and prohibit access through the opening and includes a first guide operatively mounted proximate the opening and having opposed guide surfaces. A portion of the door panel moves through the first guide's opposed surfaces during opening and closing, and at least a portion of the opposed surfaces extends into the opening. A second guide is operatively mounted proximate the opening and has opposed surfaces between which a portion of the door panel is guided during opening and closing, wherein at least a portion of the second guide's opposed surfaces extends into the opening. A guide moving assembly is operatively connected to at least one of the first or second guides, where, in conjunction with movement of the door panel, at least a portion of one or both of the guides is movable between a first position and a second position.

In another aspect of the present invention including the guide moving assembly, an actuator is utilized with a track wherein at least one of the guides is operatively connected thereto. The actuator and track cooperate to move the guide between the first and second position. Preferably, in one of the first or second positions, one of the guides extends into the opening, and in the other of the first or second positions, at least a portion of one of the guide does not significantly extend into the opening.

In another embodiment of the invention, a counter-weight is operatively attached to the door panel and a drive means to facilitate movement of the door panel. A chute including a path of movement for the counter-weight is proximate the opening and is operatively connected to at least one of the guides, which is preferably pivotably mounted near the opening. A deflection member is attached to the guide and positioned within the path of movement of the counter-weight. As the counter-weight contacts the deflection member in a first direction, the guide will move from its first position to its second position; and, upon contact of the counter-weight with the deflection member in a second direction, the guide will move from its second position and return to its first position.

In another embodiment of the invention, a method is provided for realigning a dislodged door panel of a high-speed door assembly. The method includes detecting displacement of the door panel from its typical operative path of travel, and, in response to the detection of the displaced door panel, reducing the speed of travel of the door panel.

In another embodiment, at least one of the guides of a high-speed door assembly is movably mounted so that it can receive contact from an outside force, e.g., lift truck, without incurring inoperative or disabling damage, or requiring manual repair. The movably mounted guide is biased into a normal operative position and upon receiving an impact sufficient to displace it from its normal operative position, will subsequently return to it normal operative configuration.

It is to be understood that the aspects and objects of the present invention described above may be combinable and that other advantages and aspects of the present invention will become apparent upon reading the following description of the drawings and detailed description of the invention.

DETAILED DESCRIPTION

Figure 2:
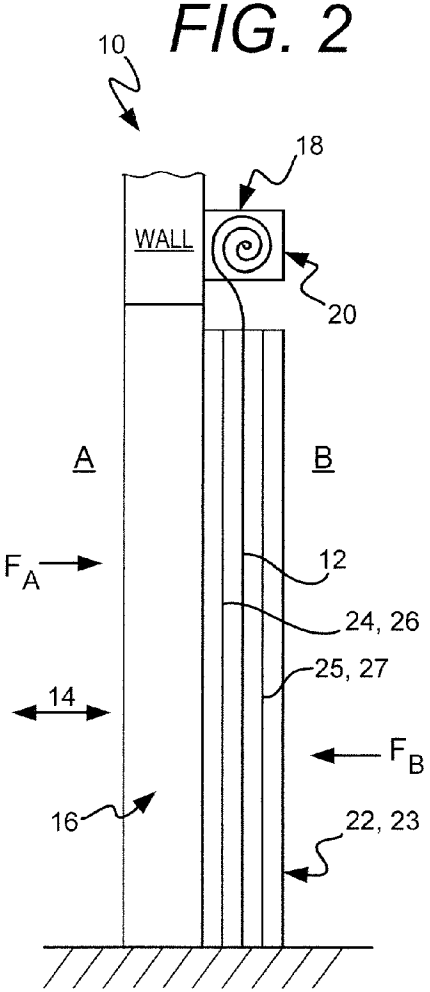
FIG. 2 is a partial cross-section view of the present invention shown in FIG. 1 and taken along line 2-2.

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
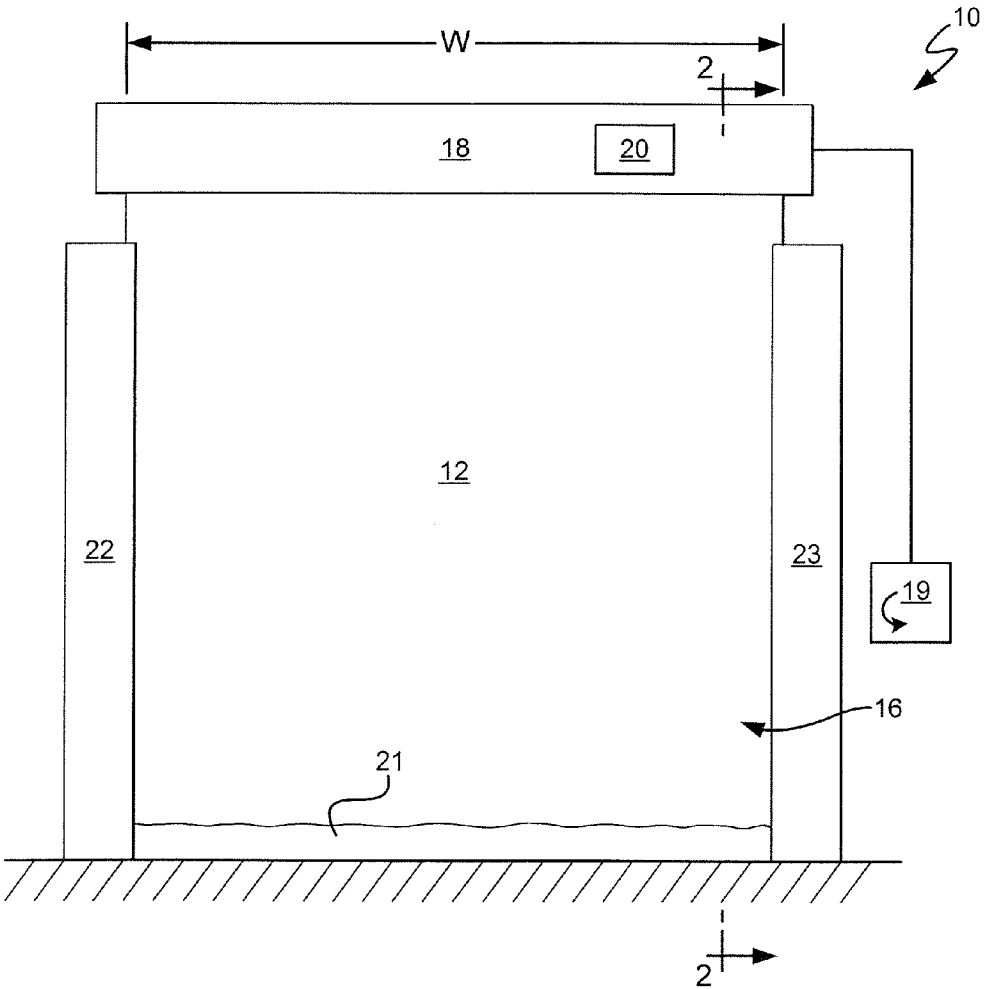
FIG. 1 is a front view of one embodiment of the present invention.
Figure 3:
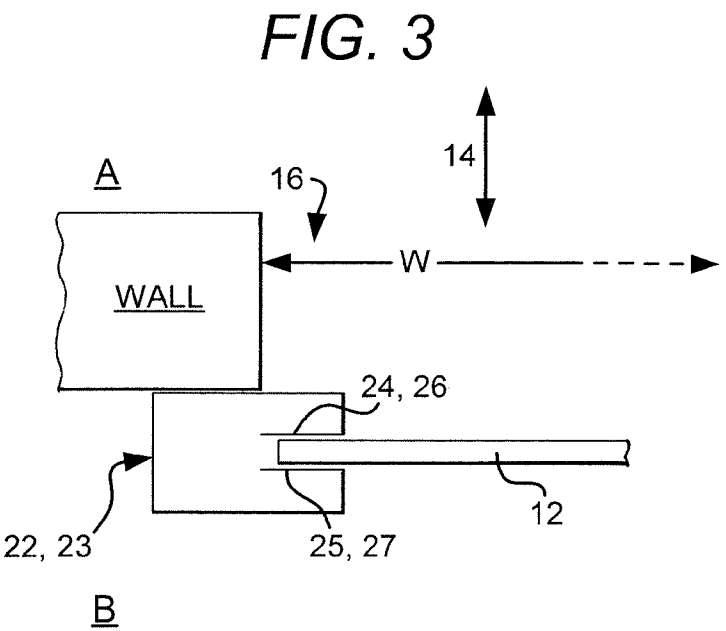
FIG. 3 is a partial top view of the present invention shown in FIG. 1.
Figure 6A:
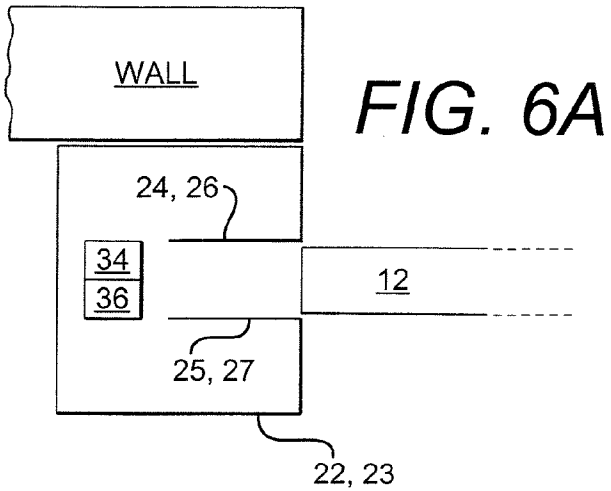
FIGS. 6A and 6B are partial top views of another embodiment of the present invention depicting a movable guide.
Figure 6B:
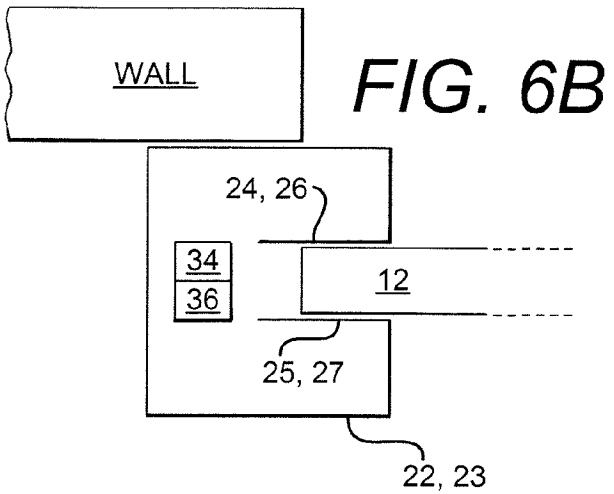

FIGS. 1, 2 and 3 generally disclose a high-speed door assembly 10 that rolls and unrolls a door panel 12 to permit and prohibit access through a passageway 14. The passageway 14 includes an opening 16 having a width W defined by opposed sides of the wall forming the opening 16. The passageway extends perpendicular to and beyond the opening. To permit access through the passageway 14, the door panel 12 is vertically displaced up and down by rolling up and unrolling on a drum (although in other embodiments, the door panel may be accumulated overhead by other means such as a track, rail, and the like. Preferably, the door panel 12 is a continuous piece of material, e.g., a flexible sheet or panel, but may be comprised of two or more segments, sheets or panels.

A drive means 18, e.g., an electric motor, is operatively connected to the door panel 12 and is mounted above the passageway 14 to move the door panel vertically up and down. The drive means 18 may also include a controller 19 and a sensor 20 in a rigid bottom bar 21 at the lower edge of the panel 12 as is known in the art. The controller 19 is responsive to the sensor 20 and has a plurality of operating modes in which to control the operation of the drive means 18 to move the door panel 12 at an opening speed of approximately 0-100 inches/second or more. The drive means 18 is responsive to the controller 19 which is preferably mounted to either one of the sides of the opening 16.

The high-speed door assembly 10 is adapted for displacement of its door panel 12 from its operative path of travel upon receiving a force for example from a collision with a fork-lift vehicle, which causes movement atypical to its normal mode of operation and may also dislodge the door from its assembly. The sensor 20 is capable of detecting either atypical alignment of the door panel 12 with its guide(s) 22, 23 or the atypical force applied to the door (for example when such as a pneumatic sensor, a strain gauge, or an accelerometer is employed as a sensor). The controller 19 responsive to the sensor 20 sending a signal indicating detection of an atypical force or misalignment of the door panel 12 with its guides, 22, 23 may be programmed to stop vertical movement of the door panel 12, reverse the direction of travel from down to up, or decrease the speed of travel of the door panel. Preferably, if the panel was moving downward, the controller 19 either stops the panel then reverses its direction and speed, or just reverses its direction and speed to roll the panel 12 up to a point where the bottom edge, in this case the bottom bar 21 can be aligned either by gravity or some manual urging back into alignment with its guides 22, 23. At that point, the controller may permit continued operation of the door panel 12 or may optionally wait for a diagnostic test which can be partially or totally manual or automated.

Figure 4:
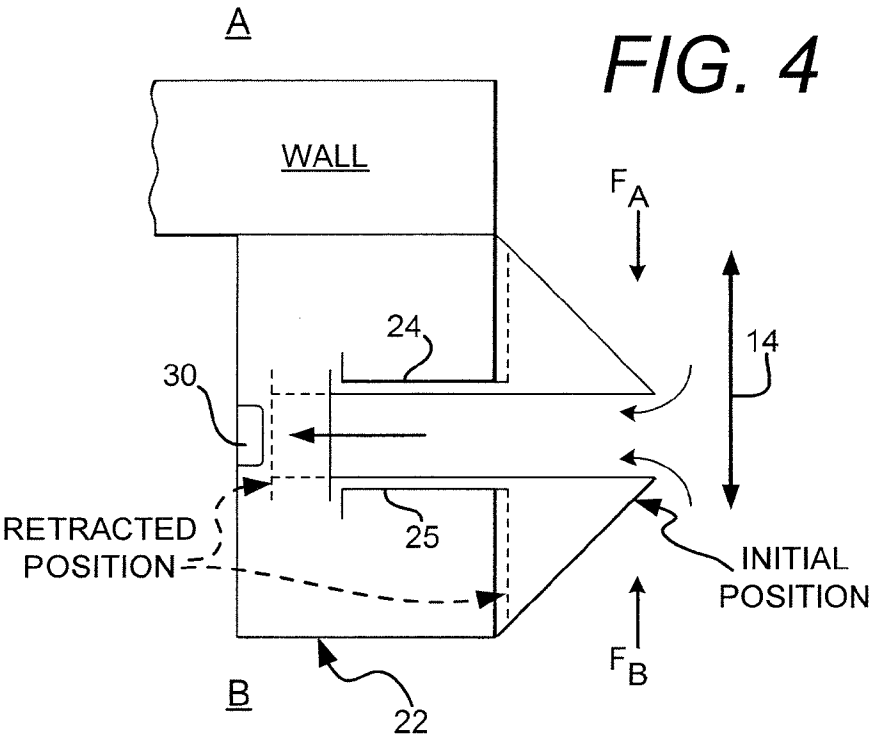
FIG. 4 is a partial top view of another embodiment of the present invention.

FIGS. 3 and 4 disclose one side of the vertical guide assembly (22) with reference numbers provided (without a separate drawing) of the identical (left-hand, right-hand) configuration of the two opposed guide assemblies 22, 23. Hence, FIG. 3 discloses a first guide 22 (23) operatively mounted on one side of the wall to which the door panel assembly is mounted and near the opening 16. FIG. 3 discloses guide surfaces 24,26 and 25, 27 between which opposite vertical margins of the door panel 12 are guided during opening and closing. At least a portion of the opposed surfaces 24, 25; 26, 27 extend into the passageway 14. The first guide 22 is spaced apart from and aligned with the second guide 23 to define a planar (or horizontal or vertical) plane defining a path of travel 28 (FIG. 5) for the door panel 12 such that a portion of the door panel—near the sides of the door panel—is guided within the first 22 and second 23 guides. To a large extent, the path of travel 28 is in a plane that is substantially parallel with the opening 16 and substantially perpendicular to the passageway 14.

Referring now to FIG. 4, one embodiment of the present invention provides that a portion of at least one of the first 22 or second 23 guides are resilient or collapsible so as to respond to an impact on them by initially retracting from the passageway 14 then rebounding to substantially their initial configuration. This may be accomplished by the guides 22, 23 being made of a flexible material, e.g., rubber, having an inherent resiliency or of bended metal wherein due to its shape has formed a resilient spring as shown in FIG. 4. It is further contemplated that a bias means 30 can be utilized with the guide 22, 23 to achieve an amount dynamic response to facilitate temporary flexing or retracting upon impact and then subsequently substantially return to an operable configuration for opening and closing. Mechanical bias mechanisms, e.g., mechanical or chemical (polymer) springs or gravity can comprise or be operatively connected to the guide.

FIGS. 10A-10C, disclose a gravity-based bias mechanism 31 wherein the guides 22, 23 essentially suspend proximate the opening 16. The guides include a slanted slot 33 wherein a pin 35 is located therein. Upon receiving an impact, the guide 22, 23 will flex on impact. Due to the geometrical configuration of the gravity or shape based bias mechanism 31, the guide 22, 23 will slide slightly upward along the pin 35 and then eventually return to its original position.

Figure 5:
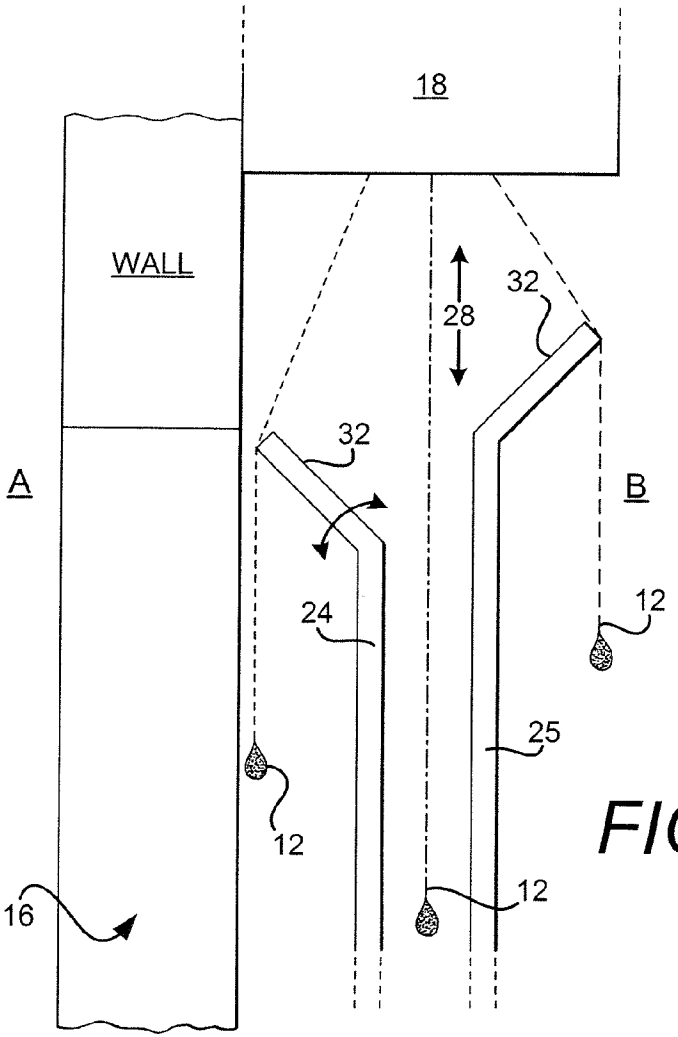
FIG. 5 is a partial side view of another embodiment of the present invention.
Figure 9:
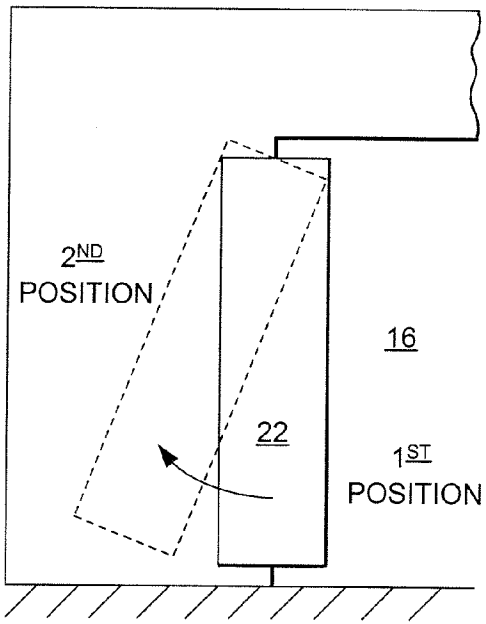
FIG. 9 is a partial front view of the present invention shown in FIGS. 8A-8D; and, FIGS. 10A-10C is a partial front view of another embodiment of the present invention depicting a movable guide utilizing a gravity or shape based bias mechanism.
Figure 7A:
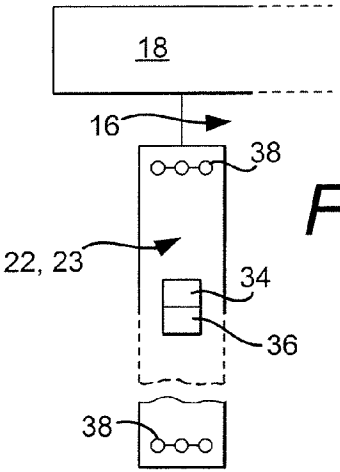
FIGS. 7A and 7B are partial front views of the present invention shown in FIGS. 6A and 6B.
Figure 7B:
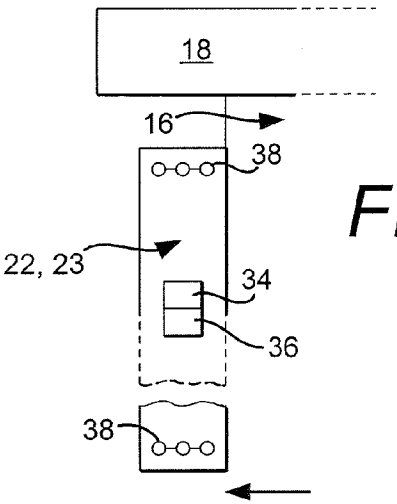
Figure 8A:
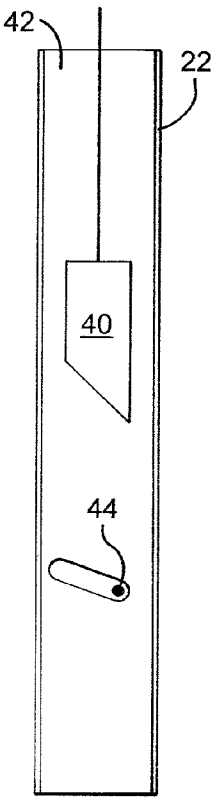
FIGS. 8A-8D are partial front views of another embodiment of the present invention depicting a movable guide.
Figure 8B:
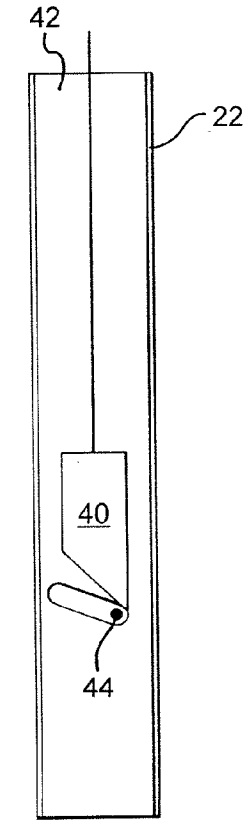
Figure 8C:
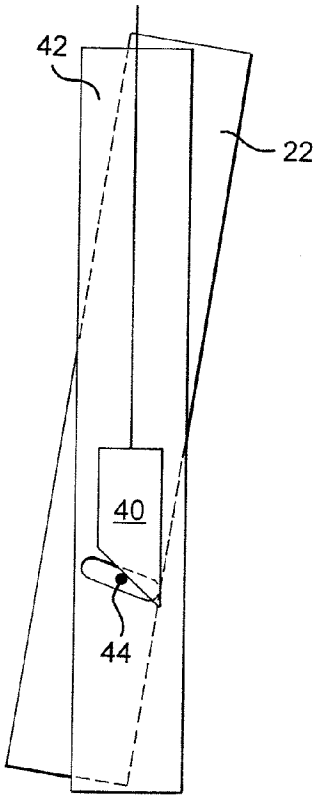
Figure 8D:
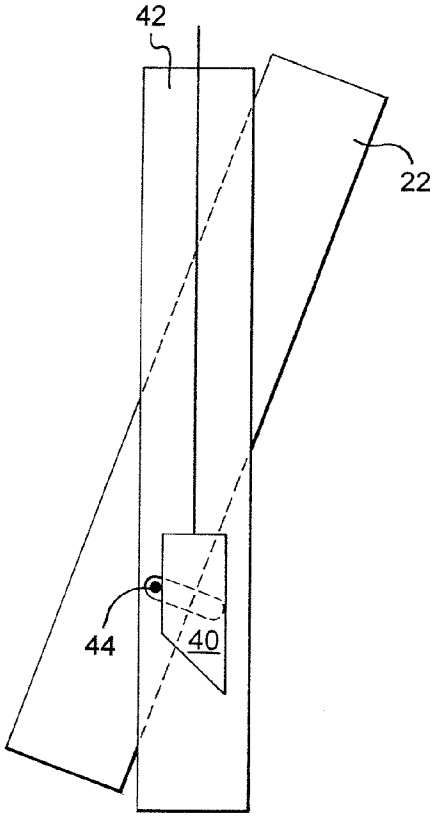

Another aspect of the present invention is shown in FIG. 5, wherein at least one—preferably both—of the guides 22, 23 of the high-speed door assembly 10 includes a realignment ramp 32 attached thereto and proximate the top of the opening 16. The realignment ramp 32 projects upward and at an angle away from the path of travel 28 so as to facilitate operative alignment of the door panel 12 within the path of travel subsequent to displacement of the door panel from the guides 22, 23.

Displacement of the door panel 12 can result from contact of a sufficient force $F_A$, $F_B$ upon the door panel to dislodge it from at least one of the guides 22, 23. The dislodging force can approach from either side A, B of the opening 16. Upon displacement of the door panel 12 from guide(s) 22, 23, the drive means 18 preferably halts movement of the door panel for a predetermined amount of time and then reinitiates movement of the door panel such that the dislodged door panel will eventually approach the top of the opening 16 wherein the bottom portion of the door panel will slip over and past the realignment ramp 32 and return within the guides 22, 23 for subsequent operation.

Upon receiving a sufficient force $F_B$ on the side B of the opening 16 where the high-speed door assembly 10 is mounted, the door panel 12 will dislodge from at least one of the guides 22, 23. Because the guides 22, 23 extend into the opening 16, the width of the door panel is less than or equal to the width W of the opening. As such, the door panel 12 is permitted to more freely move through the opening 16 and is primarily prevented from returning through the opening by the guides 22, 23 extending therein—as opposed to the structure, e.g., wall, defining the sides of the opening. Upon detection of the displaced door panel 12, the sensor 20 will send a signal to the controller 19. The controller 19 will change the operating mode of the drive means 18 and the door panel will eventually be moved up toward the top of the opening 16 and pass by the realignment ramp 32 to return within the guide and on plane within the path of travel 28.

The realignment ramp 32 is movable so that the entire door panel 12 will eventually be pulled past the movable realignment ramp and return between the guides 22, 23. Various embodiments of the movable realignment ramp 32 are envisioned by the present invention, including, and not limited to: being operatively attached to one of the surfaces 24, 25, 26, 27 of the guides 22, 23; being integral with one of the surfaces of the guides; and being biased—inherently via physical composition or shape, or mechanically, e.g., spring, coil, and the like.

In a preferred embodiment, each guide 22, 23 will include a pair the realignment ramps 32 to facilitate normal operative configuration of the door panel 12 independent of the side of the opening 16 on which the door panel is displaced.

As shown thus far, due primarily to the configuration of the guides 22, 23 extending within the opening 16, the "self-repairable" high-speed door assembly 10 of the present invention is capable of quick and easy reconfiguration regardless of the direction of the dislodging force. And although the extension of a portion of the guides 22, 23 appears to lessen the width W of the opening 16, the movable guide described herein is capable of collapsing and/or retracting and thus effectively providing a width substantially as wide as the opening.

Alternatively, another aspect of the present invention is shown in FIGS. 6A, 6B, 7A, and 7B and is directed to a guide moving assembly 34 that is operatively connected to at least one of the guides 22, 23. In conjunction with raising and lowering of the door panel 12, a portion of one of the guides is movable between a first position and a second position. In the first position, the guide(s) extends into the opening 16, (see FIGS. 6A and 7A) and in the second position, at least a portion of the guide(s) does not extend into the opening (see FIGS. 6B and 7B); and vice versa. The guide moving assembly 34 includes an actuator 36 operatively connected to the guide(s) 22, 23. Preferably, the actuator 36 cooperates with a track 38—single or multiple rail—upon which the guide 22, 23 is operatively connected. The actuator 36 cooperates with the track 38 to move the guide 22, 23 between the first and second positions. Upon detection of an approaching vehicle intending to travel through the opening 16, the actuator 36 will move at least a portion of the guide(s) 22, 23 from its initial position so as not to extend into the opening. Thus, as the door panel 12 is being moved upward to permit access through the opening 16, at least a portion of the guide(s) 22, 23 will be moved and retracted from substantially extending into the opening to expose its full width W for passage of the vehicle there through. Subsequent to the passage of the vehicle through the opening 16 and in conjunction with the downward movement of the door panel 12 to prohibit access through the opening, the actuator 36 will return the guide(s) 22, 23 to its initial position as the door panel 12 is lowered.

It is to be understood that various types of actuators known to one of ordinary skill in the art can be utilized with the present invention, including, and not limited to: a motor and cooperating cam, an air cylinder, and an electric solenoid.

Another embodiment of an alternate guide moving assembly is shown in FIGS. 8A through 8D; 9A, and 9B and includes a counter-weight 40 operatively attached to the door panel—preferably via the drive means 18. This embodiment moves a lower portion of the guides which are most commonly hit by traffic out of the passageway 14 beginning upon initial movement of the door panel 12 upwardly and replaces the guides for guiding upon closing of the door panel 12.

The counter-weight 40 is a source of potential energy utilized to facilitate the upward movement of the door panel 12 along its path of travel 28. The guide 22, 23 is preferably pivotably mounted near the opening 16 and operatively attached to a chute 42. Although the guide 22, 23 extends into the opening, the chute 42 does not. The chute 42 includes a path for the counter-weight 40 to travel. A deflection member 44 is attached to the guide 22, 23 and in line with the counter-weight's path within the chute 42. Upon opening the door panel 12, the counter-weight 40 will eventually contact the deflection member 44 wherein the guide 22, 23 will be subsequently moved from its first position. Upon closing of the door panel 12, cooperation of the counter-weight 40 with the deflection member 44 will eventually move the guide 22, 23 from its second—retracted—position and return it to its first position.

Due to the pivotable mounting of the guide 22, 23 near the opening 16, it is apparent that although a portion of the guide will be retracted to expose the full width W of the opening, a portion of the guide may remain or further extend into the opening. When permitting access through the opening 16, it is preferable to move the pivotable guide(s) 22, 23 such that the full width W of the opening 16 is exposed to a height of at least approximately 4 feet to accommodate unencumbered passage of transport vehicles through the opening. In consideration of the interrelated and/or cooperating components of the high-speed door assembly 10 of the present invention—e.g., height and width of opening 16 and door panel 12; degree of pivot for the guide 22, 23; shape or geometry of the counter-weight 40 and the cooperating deflection member 44—it is further apparent that without undue experimentation, the door assembly of the present invention can be configured by one of ordinary skill to attain the desired operating characteristics of the high-speed door assembly.

The movable characteristics of the guides 22, 23 described herein, whether the guide is collapsible, retractable, or pivotable, provide the high-speed door assembly 10 of the present invention with ability for adaptation as a separator between differing environments, e.g., cold/warm storage, humidity, clean rooms. It is contemplated by the present invention that the guides 22, 23 can be extruded of an engineered material, e.g., plastic, fiberglass, foam, and combinations thereof, that lend themselves to use in such environments, wherein lower costs due to repair or replacement will be achieved. For example, energy costs related to insufficient insulation or the prevention/reduction of accumulated frost on the guide 22, 23 can be reduced by the implementation of guides including specifically engineered material(s) suited for such purposes.

It is to be understood that additional embodiments of the high-speed door assembly described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

We claim:

1. A high-speed door assembly operatively mounted proximate an opening having a width defined by opposed sides, the high-speed door assembly being capable of vertically moving a door panel to permit and prohibit access through the opening, the high-speed door assembly comprising:

a first guide operatively mounted proximate the opening and having opposed surfaces between which a portion of the door panel is guided during opening and closing and wherein at least a portion of the opposed surfaces extends into the opening;

a second guide operatively mounted proximate the opening and having opposed surfaces between which a portion of the door panel is guided during opening and closing and wherein at least a portion of the opposed surfaces extends into the opening; and, a guide moving assembly operatively connected to at least one of the first or second guides, where, in conjunction with opening and closing of the door panel, at least a portion of at least one of the first or second guides move between a first position and a second position, the guide moving assembly having a counter-weight operatively attached to the door panel;

a chute mounted proximate the opening and operatively attached to at least one of the first or second guides, the chute including a path to guide the counter-weight; and, a deflection member attached to at least one of the first or second guides and positioned within the path to guide the counter-weight, wherein upon initial contact of the counter-weight with the deflection member, the guide will move.

2. The high-speed door assembly of claim 1 wherein the at least first or second guides extends operatively into the opening in the first position to guide the door panel, and a portion of the at least first or second guide does not significantly extend into the opening in the second position.

3. The high-speed door assembly of claim 1 wherein the guide moving assembly includes an actuator.

4. The high-speed door assembly of claim 1 wherein the guide moving assembly includes a gravity-based bias mechanism.

5. The high-speed door assembly of claim 1 wherein the first guide being pivotably mounted proximate the opening.

* * * * *